US009107549B2

(12) United States Patent
Crevling, Jr. et al.

(10) Patent No.: US 9,107,549 B2
(45) **Date of Patent: *Aug. 18, 2015**

(54) REMOVABLE INTERNAL AIR DIFFUSER

(75) Inventors: Robert L. Crevling, Jr., Williamsport, PA (US); James P. Blackwell, Jr., Williamsport, PA (US); Matthew S. Kepner, Watsontown, PA (US)

(73) Assignee: SHOP VAC CORPORATION, Williamsport, PA (US)

( * ) Notice: Subject to any disclaimer, the term of this patent is extended or adjusted under 35 U.S.C. 154(b) by 920 days.

This patent is subject to a terminal disclaimer.

(21) Appl. No.: 12/620,229

(22) Filed: Nov. 17, 2009

(65) Prior Publication Data

US 2010/0071151 A1 Mar. 25, 2010

Related U.S. Application Data

(63) Continuation of application No. 11/061,872, filed on Feb. 17, 2005, now Pat. No. 7,627,928.

(51) Int. Cl.

| | |
|---|---|
| ***A47L 9/00*** | (2006.01) |
| ***A47L 5/00*** | (2006.01) |
| ***A47L 7/00*** | (2006.01) |
| ***A47L 5/14*** | (2006.01) |

(52) U.S. Cl.

CPC ..... *A47L 7/0019* (2013.01); *A47L 5/14* (2013.01); *A47L 7/0028* (2013.01); *A47L 9/0081* (2013.01)

(58) Field of Classification Search

CPC ..... A47L 9/0081
USPC ..... 15/326
See application file for complete search history.

(56) References Cited

U.S. PATENT DOCUMENTS

| | | | | |
|---|---|---|---|---|
| 2,253,310 | A | | 8/1941 | Smellie |
| 2,328,236 | A | | 8/1943 | Stoner |
| 2,959,804 | A | * | 11/1960 | Faber ..... 15/330 |
| 3,466,696 | A | * | 9/1969 | Grellsson ..... 15/327.7 |
| 3,882,961 | A | * | 5/1975 | Cannan et al. ..... 181/258 |
| 3,924,291 | A | | 12/1975 | Tschudy et al. |
| 4,015,683 | A | | 4/1977 | Williams |
| 4,280,245 | A | | 7/1981 | Hiester |
| 4,420,094 | A | | 12/1983 | Chapin |
| 4,476,995 | A | | 10/1984 | Bellino et al. |

(Continued)

OTHER PUBLICATIONS

International Search Report for PCT/US2005/044082, dated May 16, 2006.

(Continued)

*Primary Examiner* — Bryan R Muller

(74) *Attorney, Agent, or Firm* — Marshall, Gerstein & Borun LLP; Randall G. Rueth

(57) ABSTRACT

Disclosed herein is a vacuum cleaner having a housing defining first and second ports. The vacuum cleaner also includes a cap assembly. The cap assembly includes a cap head to close the first port such that airflow is directed via a flow path to the second port, a sound-influencing material, the sound-influencing material removably held to the cap head and disposed within the flow path to reduce noise effected by the airflow. The flow path is configured to cause the airflow to pass through the sound-influencing material and the flow path to the second port. The sound-influencing material is removable to allow cleaning of the sound-influencing material. The sound-influencing material may include a reticulated foam roll disposed in the frame to diffuse the discharge airflow.

16 Claims, 10 Drawing Sheets

(56) References Cited

U.S. PATENT DOCUMENTS

| | | | | |
|---|---|---|---|---|
| 4,683,608 | A * | 8/1987 | Berfield et al. | 15/328 |
| 5,528,787 | A | 6/1996 | Cutler | |
| 5,765,257 | A | 6/1998 | Steger et al. | |
| 6,035,485 | A | 3/2000 | Holsten | |
| D437,466 | S | 2/2001 | Song | |
| 6,363,574 | B2 | 4/2002 | Worden et al. | |
| 6,484,351 | B2 | 11/2002 | Griffin et al. | |
| 6,499,182 | B2 * | 12/2002 | Berfield et al. | 15/330 |
| 6,530,116 | B2 * | 3/2003 | Berfield et al. | 15/328 |
| D478,697 | S | 8/2003 | Song | |
| 6,680,551 | B2 | 1/2004 | Bates et al. | |
| 7,627,928 | B2 | 12/2009 | Crevling, Jr. et al. | |
| 2002/0178533 | A1 | 12/2002 | Berfield et al. | |
| 2004/0200029 | A1 | 10/2004 | Jin et al. | |

OTHER PUBLICATIONS

Written Opinion of the International Searching Authority for PCT/US2005/044082, dated May 16, 2006.

* cited by examiner

REMOVABLE INTERNAL AIR DIFFUSER

CROSS REFERENCE TO RELATED APPLICATION

This application is a continuation application of U.S. patent application Ser. No. 11/061,872 filed on Feb. 17, 2005 titled "Removable Internal Air Diffuser," the disclosure of which is incorporated herein by reference in its entirety for all purposes.

FIELD OF THE INVENTION

The invention generally relates to vacuum cleaners and, more particularly, to vacuum cleaners having both vacuum and blower modes of operation.

BRIEF DESCRIPTION OF RELATED TECHNOLOGY

The collection of air during operation of vacuum cleaners typically involves the generation of high-speed airflows. Unfortunately, the noise associated with the generation and discharge of high-speed airflows can be at disturbing levels. To address this problem, an outlet port of many vacuum cleaners is modified with a muffler to dampen the noise. The airflow is then discharged through the modified outlet port after encountering the muffler.

Some vacuum cleaners, such as wet/dry vacuum cleaners, utilize the high-speed airflow in a blower mode of operation. The airflow is directed at a target using a hose, wand or other accessory item attached to a blower port. In many cases, the blower port is the same outlet port used for discharging the airflow generated when the vacuum cleaner is not used as a blower, such as during operation in a vacuum cleaner mode. Consequently, the blower port is muffled to dampen noise during operation in the vacuum cleaner mode. For operation in the blower mode, the muffler is removed to enable the attachment of the hose, wand or other accessory item to the blower port. In some cases, the muffler engages the blower port in a manner similar to the hose, wand or other accessory item. As a result, the muffler projects out from the blower port, thereby becoming an inconvenient obstacle during operation in the vacuum cleaner mode.

In other past designs, vacuum cleaners have an additional outlet port dedicated to handling the discharge airflow. A dedicated exhaust port may be desirable if dust and other messes would otherwise result from discharging the airflow through the blower port. The dedicated exhaust port need not accommodate a hose, wand, or other accessory item for blower mode operation and, therefore, may be shaped and sized to scatter and diffuse the discharge airflow. Scattering or diffusing the discharge airflow helps avoid the dust creation problem because, with a port dedicated to vacuum discharge airflow, the blower port is typically blocked during operation in the vacuum cleaner mode.

To dampen the noise generated at the dedicated exhaust port, sound-absorbent material has been incorporated into a duct leading to the dedicated exhaust port. The placement of the sound-absorbent material in the duct advantageously avoids the inconvenience resulting from a muffler projecting outwardly from the port. However, the placement in the duct limits or prevents access to the sound-absorbent material, which may be necessary in connection with replacement, cleaning, or other servicing efforts.

SUMMARY

In accordance with one aspect, a vacuum cleaner has a housing defining first and second ports, and a cap assembly.

The cap assembly includes a cap head to close the first port such that airflow is directed via a flow path to the second port, and a sound-influencing material removably held to the cap head and disposed within the flow path to reduce noise effected by the airflow. The flow path is configured to cause the airflow to pass through the sound-influencing material and the flow path to the second port. The sound-influencing material is removable to allow the cleaning of the sound-influencing material.

In one embodiment, the first port is a blower port and the second port is an exhaust port. The housing may include a lid assembly and a tank covered by the lid assembly, and the blower port and the exhaust port may be defined by the lid assembly.

In some embodiments the sound-influencing material may have a recess therein where the airflow is passed through the recess of the sound-influencing material.

In yet another embodiment, the first port may be operable to output airflow during operation in a first mode and the second port may be operable to discharge airflow during operation in a second mode. In one example, the first mode is a blow mode and the second mode is a vacuum mode. In some cases the cap assembly may be removed from the first port during operation in the first mode.

The cap assembly may further include a frame coupled to the cap head to support the sound-influencing material within the flow path. The airflow may pass through the frame to allow the airflow to interact with the sound-influencing material. The cap head may include a plurality of locking slots, and the frame may include a support base and a plurality of legs extending therefrom, each leg having a respective resilient tab to engage a corresponding locking slot of the plurality of locking slots, such that the cap head and a cap body can be decoupled for disassembly of the cap assembly. The support base may be formed as a pair of concentric circles connected by radial arms. The flow path may be defined by interior walls of the housing positioned to effect at least one redirection of the airflow after the airflow passes through the frame and interacts with the sound-influencing material.

In some embodiments, the cap assembly is removably engaged with the first port during operation in a vacuum mode, and the cap assembly is removed from the first port during operation in a blower mode.

The sound-influencing material may include reticulated foam to diffuse the airflow.

The sound-influencing material may be an annular cylinder shape, in one example.

In accordance with another aspect, a vacuum cleaner capable of operation in a first mode and a second mode is disclosed. The vacuum cleaner includes a housing defining a first port for output airflow during operation in the first mode and a second port for discharge airflow during operation in the second mode. The vacuum cleaner further includes a removable cap assembly. The removable cap assembly includes a cap head to close the first port such that the airflow is directed via a flow path to the second port, and a sound-influencing material having a recess therein, the sound-influencing material removably held to the cap head and disposed within the flow path to reduce noise effected by the airflow. The flow path is configured to cause the airflow to pass through the sound-influencing material and the flow path to the second port. The sound-influencing material is removable to allow the cleaning of the sound-influencing material.

In one embodiment, the housing may include a lid assembly and a tank covered by the lid assembly, and the lid assembly may define the blower port, the exhaust port, and the flow path.

In another embodiment, the cap assembly further includes a frame connected to the cap head and disposed in the flow path to support the sound-influencing material within the flow path. The airflow may pass through the cap frame to allow the discharge airflow to interact with the sound-influencing material. The cap assembly may include a cap head having a plurality of locking slots, and the frame may include a support base and a plurality of legs extending therefrom, each leg having a respective resilient tab to engage a corresponding locking slot of the plurality of locking slots, such that the cap head and a cap body can be decoupled for disassembly of the cap assembly. The support base may be formed as a pair of concentric circles connected by radial arms. The airflow may pass through the cap frame to allow the airflow to interact with the sound-influencing material. The flow path may be defined by interior walls of the housing positioned to effect at least one redirection of the airflow after the airflow passes through the frame and interacts with the sound-influencing material.

In accordance with yet another aspect, capable of operation in a blower mode and a vacuum cleaner mode including a housing defining a first port for output airflow during operation in the blower mode and a second for discharge airflow during operation in the vacuum cleaner mode. The vacuum cleaner also including a removable cap assembly. The removable cap assembly including a means for closing the first port such that airflow is directed via a flow path to the second port, a sound-influencing material having a recess therein, a means for removably holding the sound-influencing material to the means to close the first port and to position the sound-influencing material within the flow path to reduce noise effected by the airflow. The flow path configured to cause the airflow to pass through the recess of the sound-influencing material and the flow path to the second port.

In one embodiment, the means to close the first port comprises a plurality of locking slots, and the means for holding the sound-influencing material comprises a plurality of legs, each leg having a respective resilient tab to engage a corresponding locking slot of the plurality of locking slots, such that the means to close the first port and a cap body can be decoupled for disassembly of the cap assembly. The airflow may pass through the means for holding the sound-influencing material to allow the airflow to interact with the sound-influencing material.

BRIEF DESCRIPTION OF THE DRAWINGS

For a more complete understanding of the invention, reference should be made to the following detailed description and accompanying drawing wherein.

Figure 1:
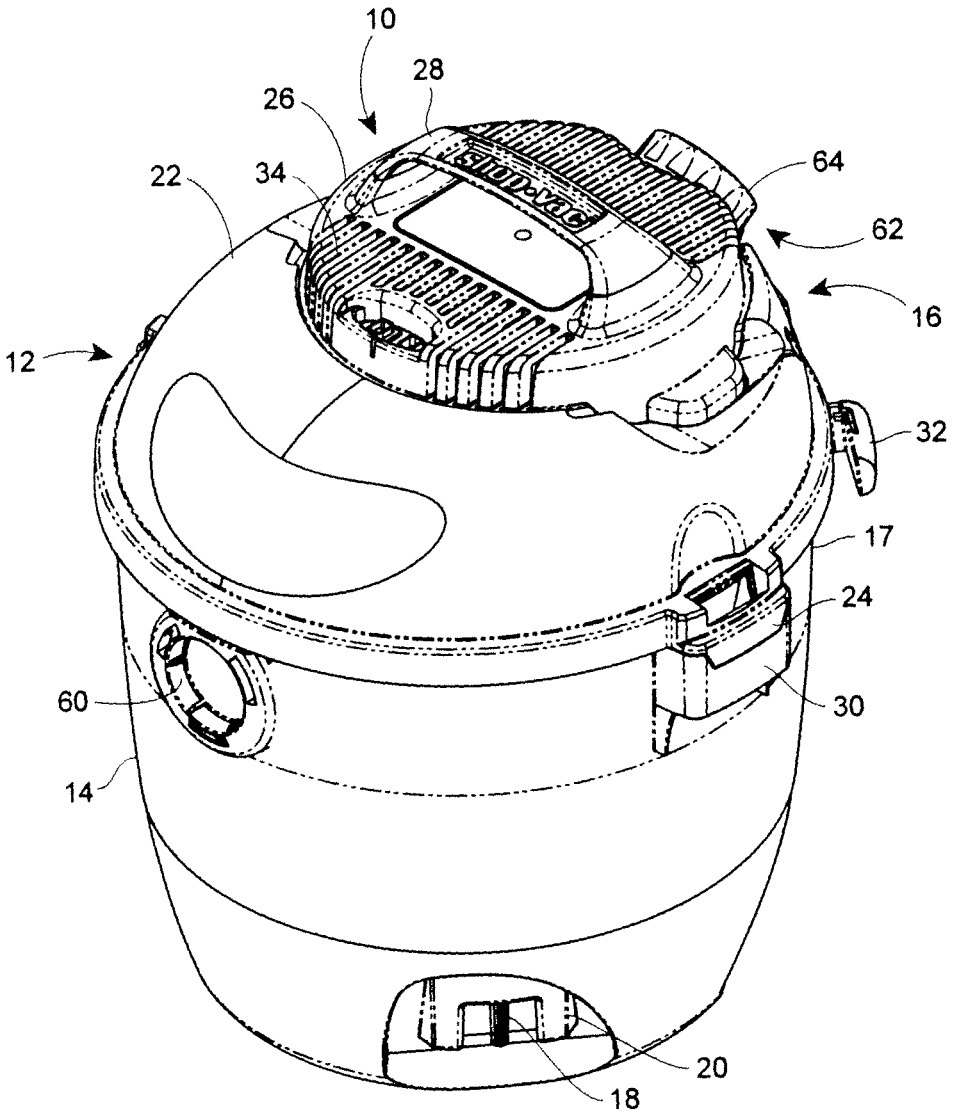
FIG. 1 is a perspective view of a vacuum cleaner in accordance with one embodiment.

While the disclosed vacuum cleaner is susceptible of embodiments in various forms, there are illustrated in the drawing (and will hereafter be described) specific embodiments of the invention, with the understanding that the disclosure is intended to be illustrative, and is not intended to limit the invention to the specific embodiments described and illustrated herein.

DETAILED DESCRIPTION

The invention generally relates to a vacuum cleaner having a cap, or cap assembly, for an outlet port where the cap assembly includes sound-influencing material to reduce noise effected by high-speed airflows generated during operation. The noise level may be reduced if, for instance, the sound-influencing material acts as a diffuser to the high-speed airflow. The cap assembly may be useful in connection with vacuum cleaners capable of operating in multiple modes, such as a blower mode and vacuum cleaner mode. In such cases, the outlet port engaged by the cap assembly may be a blower port of the vacuum cleaner.

When the high-speed airflow encounters the capped blower port, the sound-influencing material reduces noise, and the high-speed airflow is directed, or redirected, to another outlet port of the vacuum cleaner. Such redirection may further reduce noise and minimize other inconveniences because the other outlet port may be configured for discharging airflows in a non-directed, or diffused, manner.

Generally, the sound-influencing material is supported by the cap assembly within a flow path leading to the other outlet port, as will be described further herein. The removable nature of the cap assembly provides for convenient access to the sound-influencing material, which may require replacement, cleaning or other servicing. To those ends, the cap assembly may be disassembled for convenient removal of the sound-influencing material. Thus, the sound-influencing material is both easily accessed and replaced despite its insertion into the flow path via the engagement of the cap assembly and the outlet port.

The features and elements of the disclosed vacuum cleaner are particularly well suited for vacuum cleaners capable of generating high-speed airflows, such as wet/dry vacuum cleaners. While embodiments of the disclosed vacuum cleaner are shown and described herein in connection with wet/dry vacuum cleaners, practice of the disclosed vacuum cleaner is not limited to such types of vacuum cleaners. On the contrary, the features and elements of the disclosed vacuum cleaner may be applied in connection with devices other than wet/dry vacuum cleaners, and in connection with devices generating airflows of any speed. Furthermore, the features and elements disclosed herein are applicable to all varieties of wet/dry vacuum cleaners, including, for example, those having pumps for liquid disposal, or detachable blowers, to name but a few.

Figure 2:
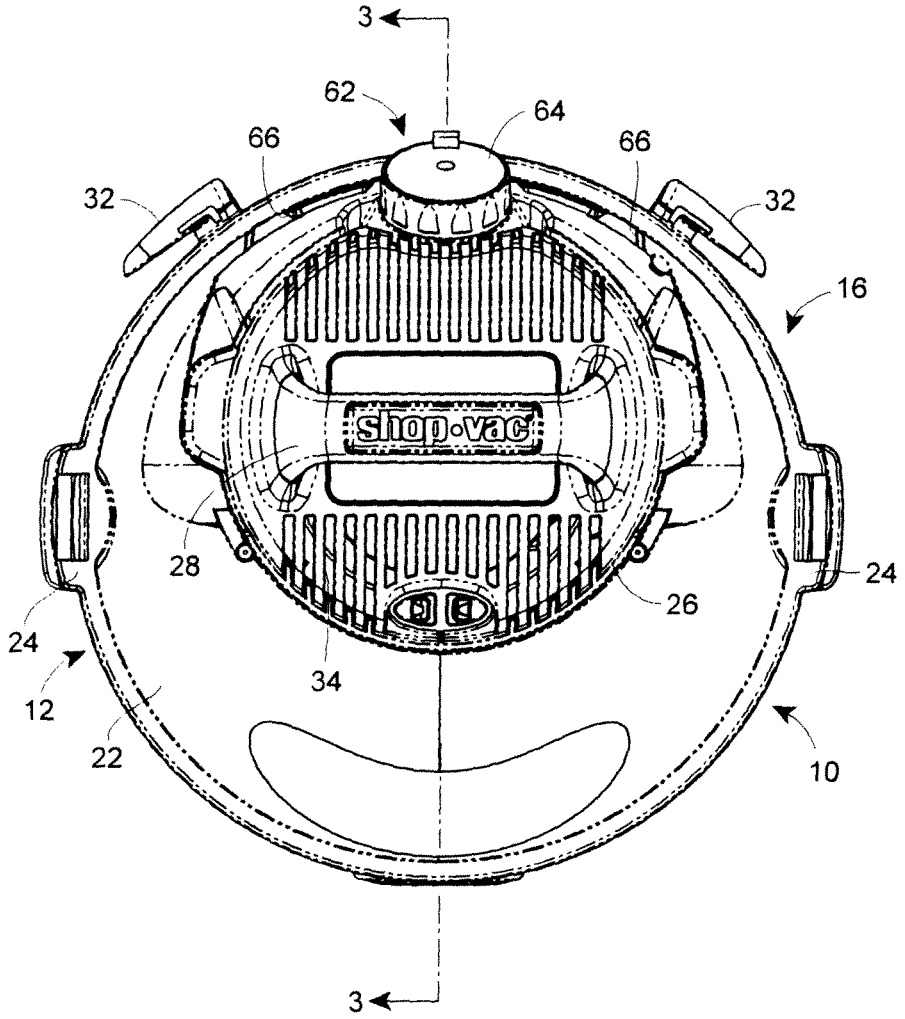
FIG. 2 is a plan view of the vacuum cleaner of FIG. 1.
Figure 3:
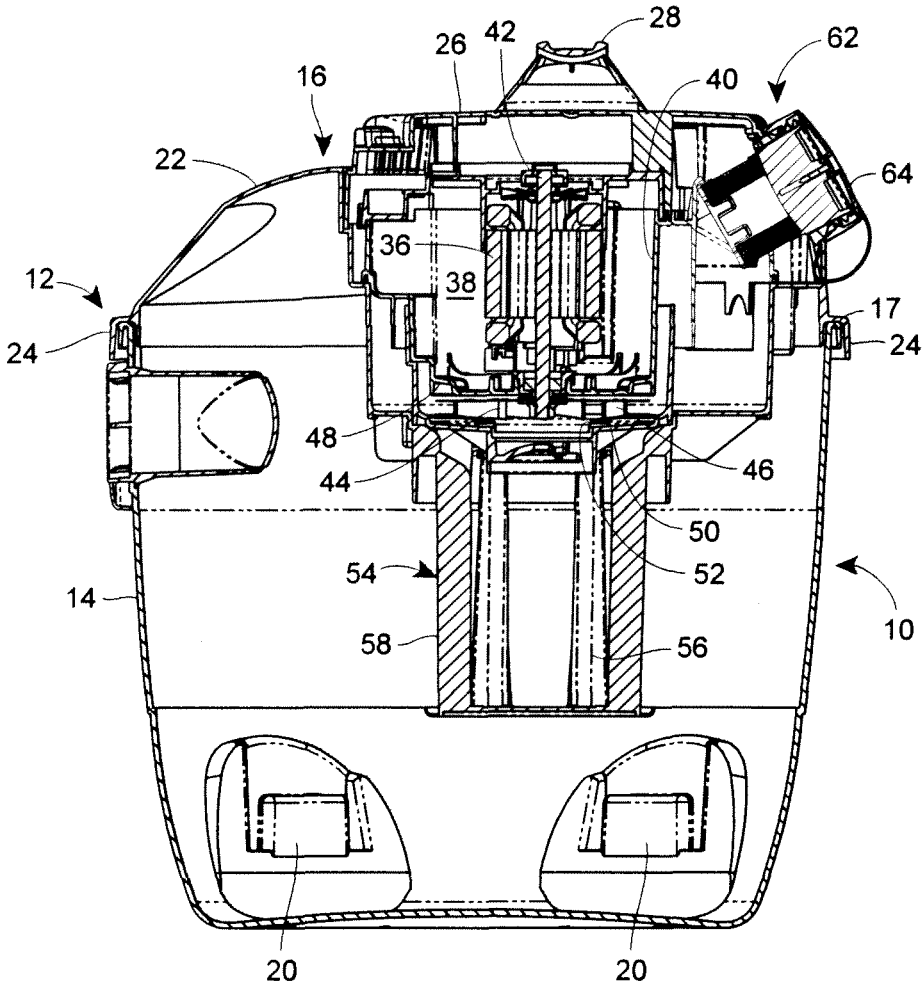
FIG. 3 is a sectional view of the vacuum cleaner of FIG. 2 taken along the line 3-3.

With reference now to FIGS. 1-3, an exemplary vacuum cleaner indicated generally at 10. The vacuum cleaner 10 includes a housing indicated generally at 12 that, in turn, includes a tank 14 for collection of debris during operation, and a lid assembly indicated generally at 16 and covering an open end 17 (FIGS. 1 and 3) of the tank 14. Although the vacuum cleaner 10 is of a canister—or tank-type variety, the embodiments of the present invention are not so limited, and may include any type of vacuum cleaners. The tank 12 is mounted on wheels (not shown) coupled to the tank 12 on swivels or posts 18 (FIG. 1) disposed in respective wheel supports 20 (FIGS. 1 and 3) to which respective wheel covers (not shown) may be attached.

The lid assembly 16 includes a lid 22 and latch areas 24 for latches (not shown) to detachably secure the lid 22 to the tank 14 at the open end 17 of the tank 14. The lid assembly 16 further includes a motor cover 26 and a handle 28 for lifting the lid assembly 16 after detachment from the tank 14. The tank 14 also includes handles 30 (best shown in FIG. 1), and power cord wrap extensions 32 (FIGS. 1 and 2) project from the lid 22.

The motor cover 26 has a number of apertures 34 to allow cooling air to reach a motor 36 (FIG. 3) disposed within the housing 12 and, more particularly, within the lid assembly 16. As best shown in FIG. 3, the apertures 34 are in communication with a motor chamber 38 defined in part by an interior wall 40 of the lid assembly 16. During operation, the motor 36 drives a shaft 42 that, in turn, drives an impeller 44 having multiple impeller vanes 46. The impeller 44 may be relied upon to generate the high-speed airflow for use in both vacuum cleaner and blower modes of operation. In alternative embodiments, the vacuum cleaner 10 may have an additional impeller for the blower mode of operation.

With continued reference to the exemplary embodiment of FIG. 3, the impeller vanes 46 rotate in a chamber defined by an upper impeller housing 48 and a lower impeller housing 50. The lower impeller housing 50 has an inlet or opening 52 through which air is drawn during operation. The opening 52 is in communication with the interior of the tank 14. Prior to reaching the opening 52, the air passes through a filter assembly indicated generally at 54 and attached to the underside of the lid assembly 16. The filter assembly 54 has a lid cage 56 that surrounds the opening 52, a filter 58 supported by the lid cage 56, and, in some embodiments, a float (not shown) disposed within the lid cage 56. The filter 58 removes debris and other materials from the airflow that are drawn into the tank via a tank inlet port 60 (FIG. 1), thereby preventing the materials from reaching or contacting the impeller 44. The float may be used to block the opening 52 to prevent the filling of the tank 14 to an extent where the liquid would otherwise pass through the opening 52 and be acted upon by the impeller 44.

Generally, the vacuum cleaner 10 may be capable of operation in multiple modes, such as a blower mode and a vacuum cleaner mode. In the vacuum cleaner mode, the vacuum cleaner 10 may be used to collect dry or wet materials using any number of tools, implements or accessories attached at the tank inlet port 60. In the blower mode, the airflow generated by the impeller 44 is not used for collection, but rather for directing the airflow at a target for cleaning and other purposes. In some embodiments, the motor cover 26 and other related components are detachable to enable portable blower mode operation. More generally, the housing 12 defines multiple outlet ports dedicated to discharging an exhaust airflow or providing an output airflow. In the exemplary embodiment shown in the drawing figures, the blower mode of operation produces the airflow at a blower port indicated generally at 62. In FIGS. 1-3, the blower port 62 is shown with a blower port cap 64 that closes or caps the blower port 62 when the vacuum cleaner 10 is operating in the vacuum cleaner mode. As will be described in greater detail below, the airflow is discharged through one or more exhaust ports 66 (FIG. 2) when the cap 64 engages the blower port 62 during operation in the vacuum cleaner mode. The exemplary embodiment shown in FIG. 2 has two exhaust ports 66 symmetrically disposed on either side of the blower port 62. More generally, capping the blower port 62 with the cap 64 directs, or redirects, the airflow to the exhaust port(s) 66 so that the discharge airflow generated during operation in the vacuum cleaner mode can be diffused and otherwise processed to reduce noise. Where the blower port 62 is designed to support a strong, directed airflow, the exhaust ports 66, in contrast, and the passages or flow path leading thereto, may be designed to diffuse the airflow prior to discharge.

Figure 4A:
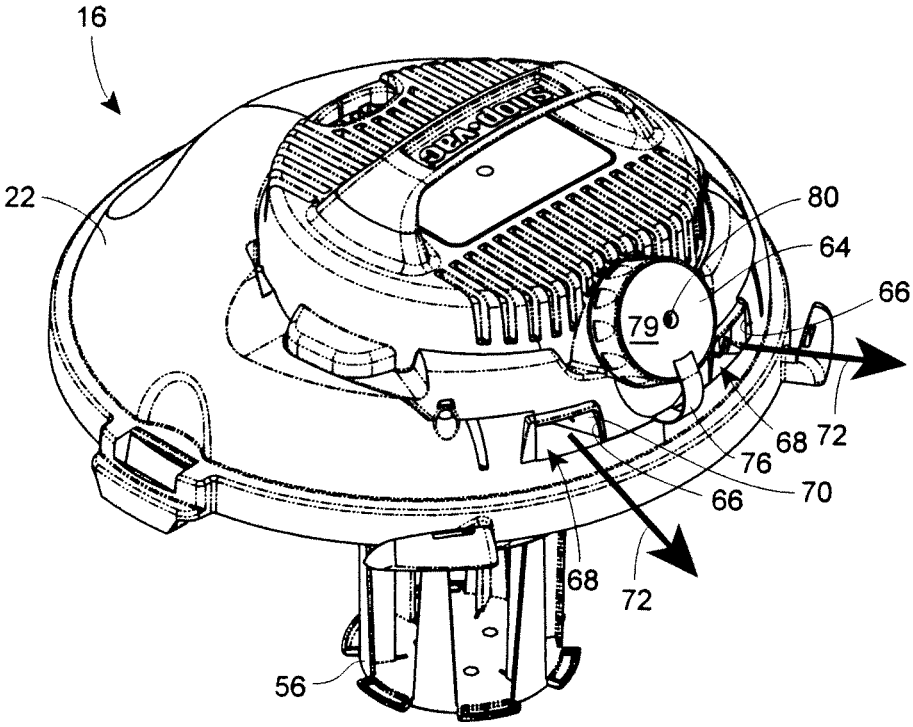
FIG. 4A is a perspective view of a vacuum cleaner lid assembly in accordance with one embodiment and shown with discharge airflow path or direction lines.

FIGS. 4A-4E show one exemplary design and the flow paths, or directions, of the airflow during operation in the vacuum cleaner mode. In the interest of ease in illustration, FIGS. 4A-4E, where elements common to multiple figures are identified with like reference numerals, depict the lid assembly 16 of the vacuum cleaner 10 without the tank 14. FIG. 4A shows the exhaust ports 66 in greater detail. Specifically, respective passages indicated generally at 68 lead to the exhaust ports 66, and have side walls 70 that diverge as exhaust (or discharge) airflow 72 approaches the exhaust ports 66. The exhaust airflow 72 is schematically depicted via directional lines for ease in illustration, it being understood that the diverging nature of the side walls 70 diffuses or scatters the exhaust airflow 72. Other airflow paths or directions identified herein are similarly simplified for ease in illustration. Directing the exhaust airflow 72 to multiple outlet ports, and allowing the exhaust airflow 72 to expand, reduces the noise level, directionality, and strength of the exhaust airflow 72.

Figure 4B:
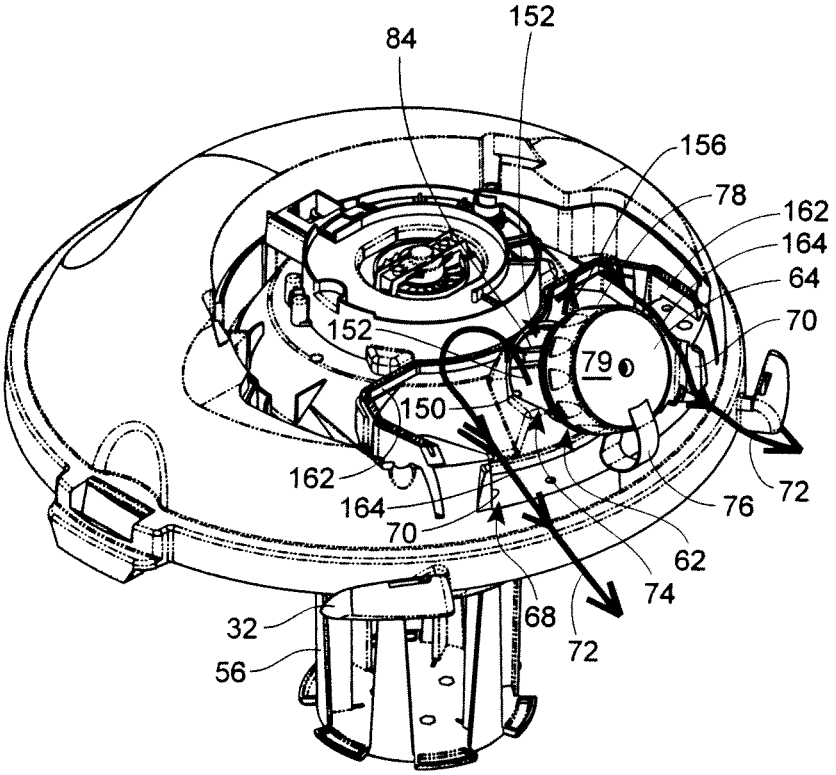
FIG. 4B is a perspective view of the vacuum cleaner lid assembly of FIG. 4A shown with the discharge airflow path or direction lines and after removal of a cover and handle.
Figure 4C:
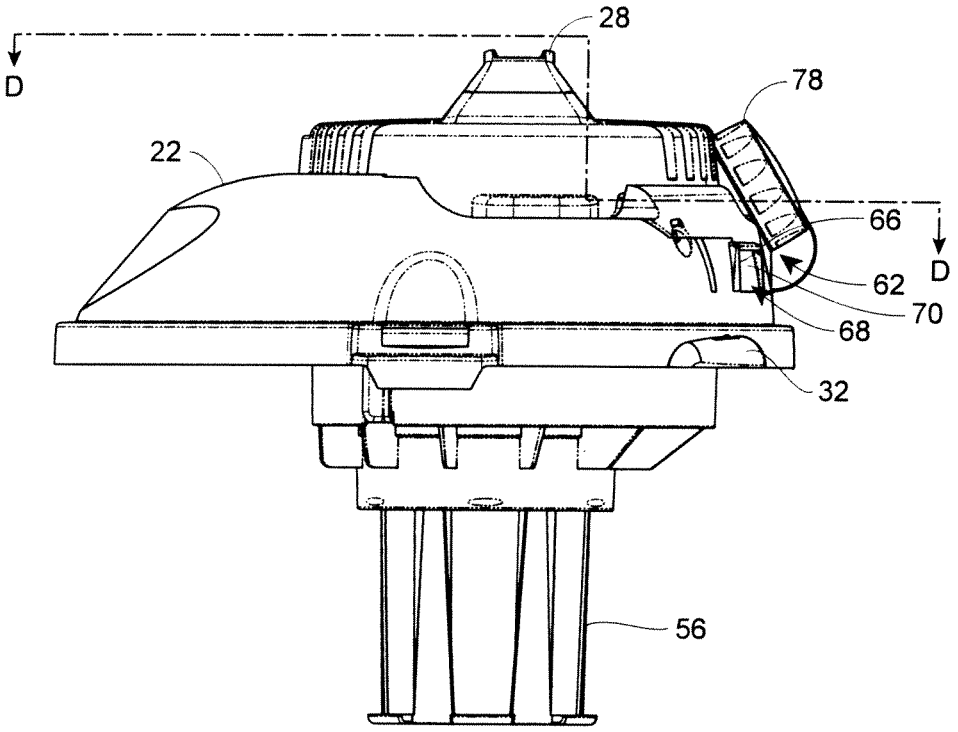
FIG. 4C is an elevational view of the vacuum cleaner lid assembly of FIG. 4A.

Referring now to FIG. 4B, the lid assembly 16 is shown without the motor cover 26 and the handle 28, and with portions of the lid 22 removed, to further reveal the flow path or direction of the exhaust airflow 72, as well as its interaction with the blower port cap 64. Depending on the operational mode, the flow path leads to either the exhaust ports 66 or the blower port 62, inasmuch as the same airflow is utilized in both the vacuum cleaner and blower modes of operation. The specific passages responsible for such delivery will be described below in connection with an exemplary embodiment, but the housing 12 may be designed in any number of ways to provide or handle airflow for the two modes of operation. Generally, the airflow passages may include features that reduce noise without significant detrimental performance effects.

The interaction of the airflow with the blower port cap 64 will now be described. The blower port cap 64 provides further noise-reducing functionality by, for instance, diffusing the exhaust airflow 72 before the airflow reaches the passages 68. Accordingly, the blower port cap 64 may be referred to herein as a diffuser cap, although the cap 64 may provide alternative or additional sound-influencing functionality, as will be described below, in connection with alternative embodiments.

More generally, the cap 64 forms part of a removable cap assembly indicated generally at 74 that engages the blower port 62 to direct, or redirect, discharge airflow generated during operation in the vacuum cleaner mode. More particularly, the cap assembly 74 closes or caps the blower port 62 during operation in the vacuum cleaner mode, and is removed during operation in the blower mode. To that end, the cap assembly 74 may include a retention strap 76 attached or affixed to a cap head 78 and/or a cover 79 of the cap head 78 affixed, for instance, via a screw fastener 80. The retention strap 76 is, in turn, attached or affixed to a loop 81 (best shown in FIGS. 5A and 5B) held in place by a retaining ridge 82

Figure 4D:
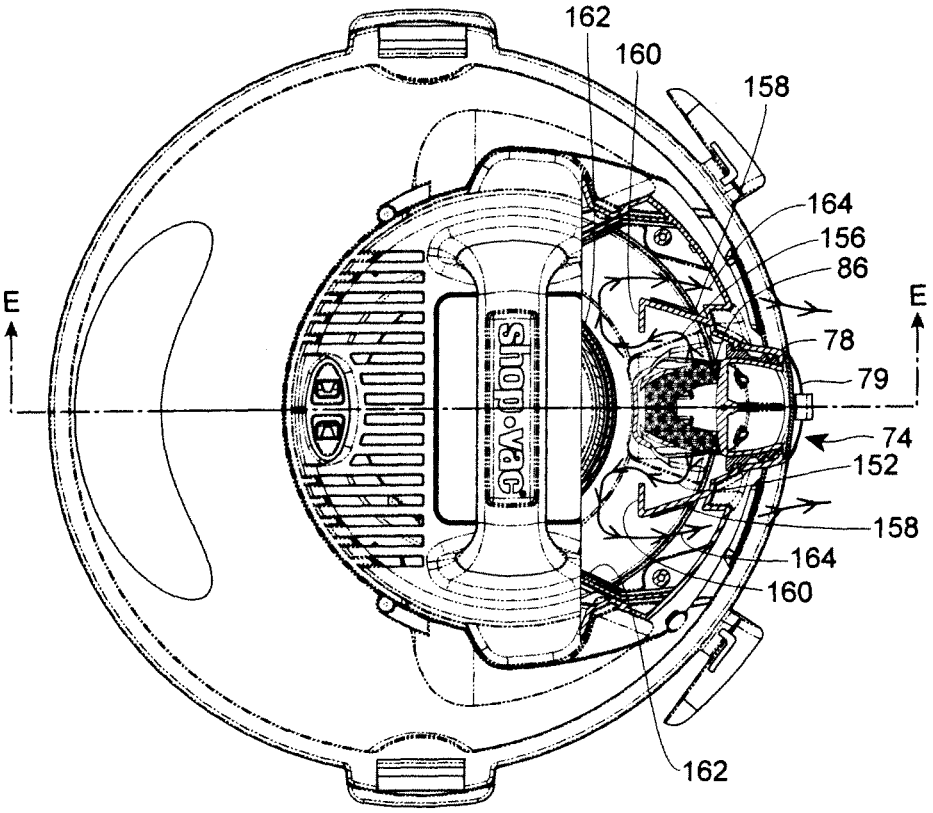
FIG. 4D is a partial sectional view of the vacuum cleaner assembly of FIG. 4C taken along the line D-D and shown with discharge airflow path or direction lines.
Figure 4E:
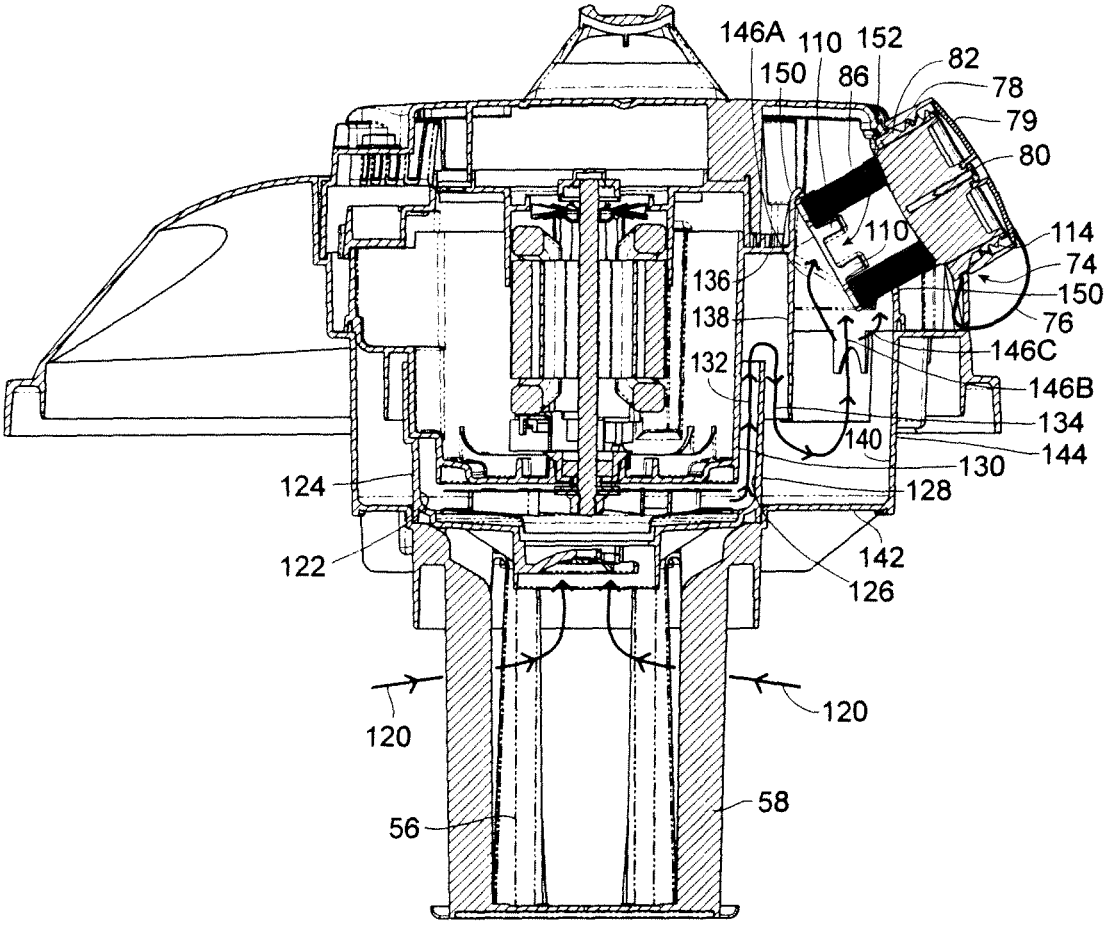
FIG. 4E is a sectional view of the vacuum cleaner assembly of FIG. 4D taken along the line E-E and shown with airflow path or direction lines.

(FIG. 4E). The loop 80 has a circumference that prevents the loop 80 from passing over the ring 82, such that the retention strap 76 and loop 80 prevent loss or misplacement of the cap assembly 74 during operation in the blower mode.

Figure 5A:
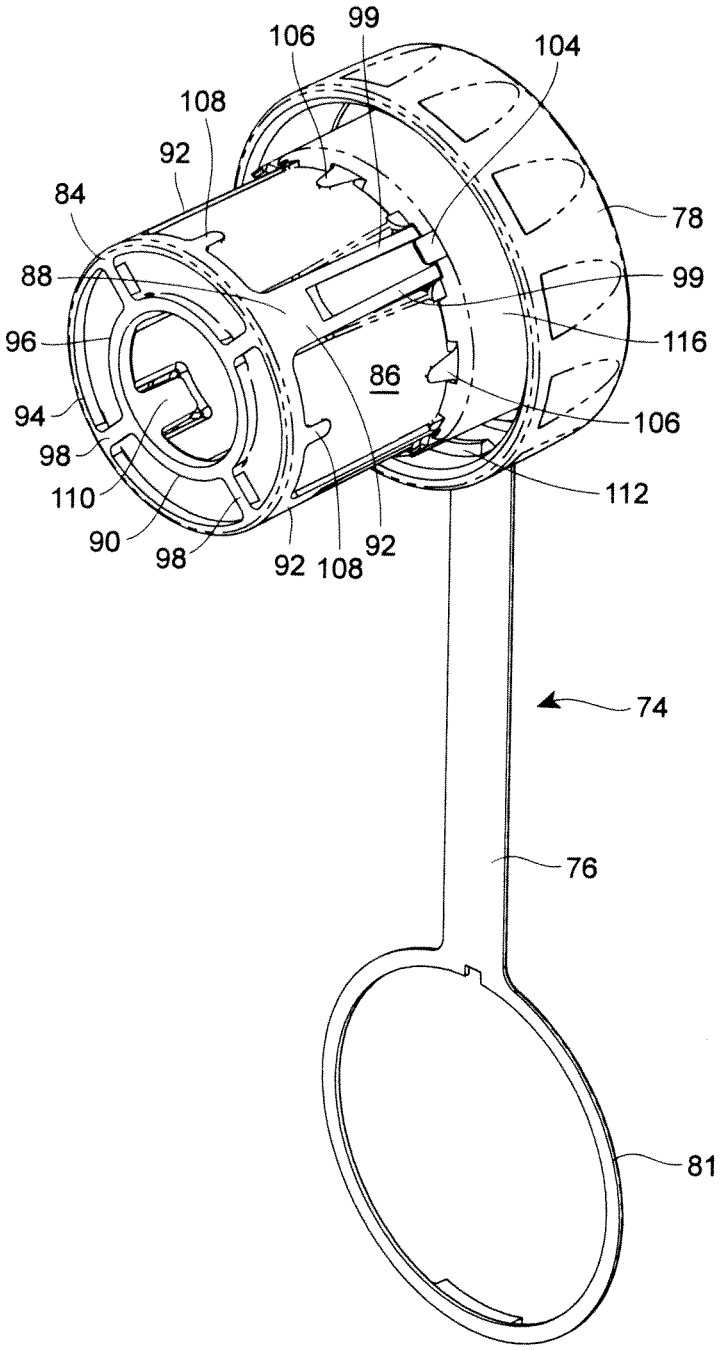
FIG. 5A is perspective view of a cap assembly of the vacuum cleaner of FIG. 1 in accordance with one embodiment; and, FIG. 5B is an exploded, perspective view of the cap assembly of FIG. 5A.
Figure 5B:
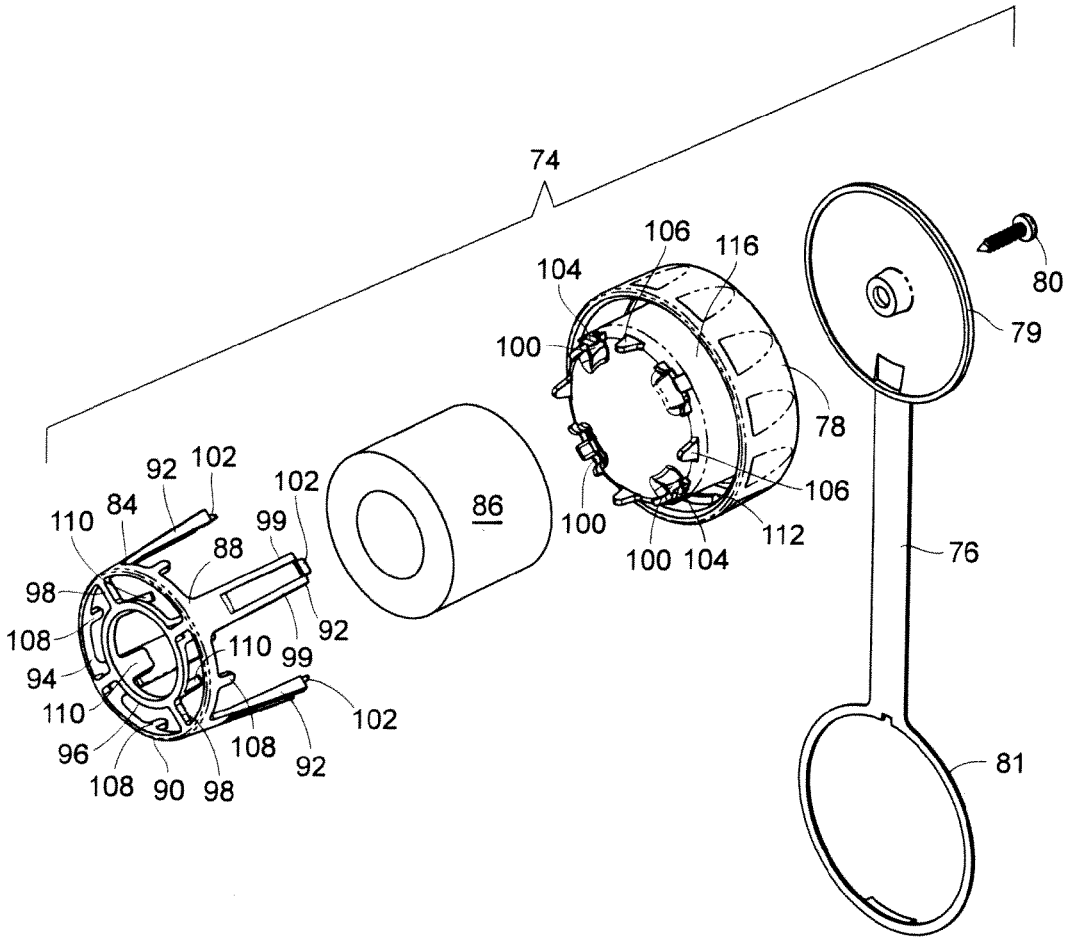

One embodiment of the cap assembly 74 is shown engaged with the blower port 62 in FIGS. 4B, 4D, and 4E, and shown in greater detail separately in FIGS. 5A and 5B. With reference to the exemplary embodiment shown in these figures, the cap assembly 74 generally includes components (e.g., the cap head 78) for closing or capping the blower port 62, as well as components for processing the airflow to reduce noise levels effected thereby. In this embodiment, the components of the cap assembly 74 may be decoupled or disassembled to enable convenient replacement, cleaning, or other servicing efforts, although alternative embodiments may have a more fixed arrangement of components to varying extents as desired in view of the present disclosure. Generally, some of the components of the cap assembly 74 are disposed in the flow path leading to the exhaust port 66. Locating the components within the flow path provides for interaction with the airflow, and alternative embodiments may have such components disposed at varying positions relative to the blower port 62, as desired.

The cap assembly 74 includes a cap body 84 coupled to the cap head 78 and inserted in a flow path (described below) leading to the exhaust ports 66. Generally, the insertion of the cap body 84 within the flow path supports the placement of sound-influencing material within the flow path. In that way, positioning the sound-influencing material in the flow path ensures that the airflow impacts or otherwise encounters the material. In contrast to the cap head 78, the cap body 84 may, but need not, act as a component of the cap assembly 74 responsible for closing the blower port 62. Instead, the cap body 84 may generally be sized for convenient insertion through the blower port 62 and into the flow path leading to the exhaust ports 66, as opposed to an insertion creating an airtight seal. The cap body 84 may have a variety of shapes to accommodate the sound-influencing material, which, in turn, may also be shaped or sized, as desired. In the exemplary embodiment shown in the figures, the sound-influencing material is presented within the flow path as a roll 86 of foam, or foam-like, material. Accordingly, the cap body 84 includes a frame 88 that holds the foam roll 86 in place despite the high-speed airflows present in the flow path. The frame 88, in turn, includes a support base 90 and a plurality of legs 92 extending therefrom. The base 90 generally prevents the foam roll 86 from undesirable displacement in the flow path, while still allowing the airflow to pass through, or impact, the foam material. Consequently, the base 90 may have any one of a variety of shapes, and is not limited to the embodiment shown in FIGS. 5A and 5B, where a pair of concentric circle portions 94, 96 are connected by radial arms 98. The base 90, as well as the frame 88 more generally, may be shaped such that a number of spaces are defined to accommodate the airflow passing through to the foam roll 86. Moreover, individual components of the frame 88 may also define spaces, in the sense that, for example, each leg 92 may include a pair of spaced prongs 99.

While portions of the cap frame 88 may be integrally formed as, for instance, a molded component, the cap assembly 74 may be decoupled, or disassembled, in some embodiments to provide access to the foam roll 86 or other components for replacement, cleaning, or other servicing. To this end, and in accordance with the exemplary embodiment best shown in FIGS. 5A and 5B, the cap head 78 includes a plurality of locking slots 100 for respectively engaging resilient tabs 102 projecting from ends of the frame legs 92. Each slot 100 may also include a resilient tab 104 that presents a snap-fit mechanism with the corresponding tab 102 of the frame leg 92. The manner in which the frame 88 is coupled to the cap head 78, however, may utilize other, differing locking, snap-fit, or other fastener mechanisms known to those skilled in the art.

The cap head 78 and the frame 88 may also include a number of projections 106, 108, and 110 that support the foam roll 86 and otherwise maintain its position within the flow path. In the exemplary embodiment best shown in FIGS. 5A and 5B, the projections 106 are pie-shaped extensions from the cap head 78, while the projections 108 are extensions from the portion 94 of the support base 90 of the frame 88. The projections 106, 108, and 110 need not be similarly sized or shaped. For example, the projections 110 extend from the portion 96 of the support base 90 to face respective legs 92 of the frame 88. To provide matching interior and exterior support for the foam roll 86, the projections 110 may have a width similar to the width of each leg 92. More generally, the projections 106, 108, and 110 may be shaped and sized so as to maximize support for the foam roll 86 while minimizing obstruction of the airflow through the frame 88.

With continued reference to FIGS. 5A and 5B, the cap head 78 may have a threaded interior wall 112 that engages matching threads 114 (FIG. 4E) of the blower port 62. Alternatively, the interior wall of the cap head 78 may have rings (not shown) that engage corresponding rings of the blower port 62 such that the cap assembly 74 snaps into position via a press-fit mechanism. Other mechanisms may be utilized to detachably secure the cap assembly 74 in position when capping the blower port 62.

The foam roll 86 of the cap assembly 74 may include, or be composed of, any sound-influencing material, where the term "influencing" is used in a broad sense to include processing of the airflow where the noise or sound may be diffused, absorbed, dampened, scattered, or otherwise reduced, or any combination of the foregoing. In one embodiment, the roll 86 is made of reticulated foam that diffuses the airflow to reduce the noise level by allowing the airflow to substantially pass through the roll 86. The roll 86 may include other air-porous materials in addition to, or in the alternative of, the reticulated foam. Other suitable materials may alternatively or additionally involve an absorption or dampening effect upon impact. Furthermore, the sound-influencing material need not be formed from rolling up a rectangular piece of foam, but rather may be shaped and positioned in accordance with the mechanism by which the noise reduction is implemented. For example, the sound-influencing material may alternatively be shaped as a flat pad of any suitable thickness disposed at an end of the cap head 78. As shown in FIGS. 5A and 5B, the cap head 78 may include an interior tube or other portion 116 extending from the end defining the cap 64 to the end coupled to the frame 88 for the purpose of ensuring that the sound-influencing material is inserted within the flow path at a suitable depth or position. This portion 116 of the cap head 78 may be similarly used to position the pad of sound-influencing material at a suitable depth or position.

With reference to FIGS. 4B, 4D, and 4E, the flow paths taken by the exhaust airflow 72 are shown. Prior to describing the exemplary embodiment shown in these figures, it should be noted that the airflow through the housing 12 and, more generally, the vacuum cleaner 10, may vary greatly depending on design choices and alternatives for the vacuum cleaner 10 well known to those skilled in the art. Moreover, although the airflow 72 is associated with the exhaust airflow generated during the vacuum cleaner mode of operation, the flow paths taken by the output airflow generated during operation in the blower mode is substantially similar, with the exception of the flow path in which the cap assembly 74 is inserted. For this reason, only the exhaust airflow paths will be described herein, with the understanding that, in the blower mode, the airflow will be directed to the blower port 62 instead of the exhaust ports 66 due to the insertion of a tube or other accessory item (not shown) in the blower port 62 instead of the cap assembly 74. Instead of allowing the airflow to pass through (as with the frame 88 and the foam roll 86), the solid nature of the accessory item blocks the flow path otherwise leading to the exhaust ports 66.

The airflow is initiated at the tank inlet port 60 in both the vacuum cleaner and blower modes of operation. After the airflow has traveled along paths or directions 120 passing through the filter 58, past the lid cage 56, and through the opening 52, the impeller 44 draws the air into a chamber 122 defined by interior walls 124, as shown in FIG. 4E. Eventually the airflow is directed out of the chamber 122 for entry into a passage 126 defined by interior walls 128 and 130. After continuing along a path 132 within the passage 126, the airflow is directed in a substantially different direction 134 by interior walls 136 and 138. The airflow then enters a chamber 140 leading to the cap assembly 74. The chamber 140 is defined by walls 142 and 144 of the lid assembly 16 that force another directional change to the airflow. Each of these directional changes is designed to reduce the noise level prior to processing by the cap assembly 74, which the airflow encounters next as it spreads within the chamber 140, as shown schematically in FIG. 4E as three airflow paths or directions 146A-146C. As a result of this spreading, the airflow encounters the cap assembly 74 from a number of directions, thereby passing through the foam roll 86 or other sound-influencing materials to varying extents and at differing positions. At least some of the airflow will pass through the frame 88 into the cylindrical spacing defined by the roll 86. Because the cap head 78 effectively closes off the other end of the cylindrical spacing, the airflow is forced to pass through the foam roll 86 between the legs 92 of the frame 88 in a radially outward direction. Other portions of the airflow will pass through the end of the foam roll 86, passing through the frame 88 between the portions 94 and 96.

Regardless of where the airflow encounters the foam roll 86, or the direction of the airflow at the point of the encounter, the airflow is generally directed via a flow path within which the foam roll 86 is disposed, forcing the airflow to interact with the foam roll 86 (or other sound-influencing material). As best shown in FIGS. 4B and 4E, the airflow is directed via the flow path by a wall 150 defining an opening indicated generally at 152 through which the airflow passes. Airflow through the opening 152 is shown schematically in FIGS. 4B and 4D as airflow direction 154, it being understood that the airflow direction 154 is only one of many directions the airflow may take in passing through the opening 152. For example, a further airflow direction 156 is also shown in FIGS. 4B and 4D after having passed through the opening 152. Each of these airflows, or airflow directions, constitute a flow path within which the foam roll 86 is disposed to diffuse or otherwise reduce the noise effected by the airflow.

As best shown in FIGS. 4B and 4D (a partial sectional view taken along the line D-D of FIG. 4C), the airflows schematically represented at the directions 154 and 156 are directed to respective exhaust ports 66 after emanating from the sides of the cap assembly 74 and through the opening 152 in a generally diffused manner. These airflows then are forced along flow paths involving one or more further redirections defined by symmetric, interior wall pairs 158 and 160 that may extend down from the motor cover 26 or, in alternative embodiments, the lid 22. The wall pairs 158 and 160 define a chamber in which the redirections occur, where the chamber is further defined by a wall composed of a U-grooved wall 162 in which a wall (not shown) extending down from the motor cover 26 is inserted. After these redirections, the airflows take on respective paths or directions shown schematically at 164 and corresponding with the exhaust airflow 72 (FIG. 4B) for discharge via the exhaust ports 66.

The foregoing description is given for clearness of understanding only, and no unnecessary limitations should be understood therefrom, as modifications within the scope of the invention may be apparent to those having ordinary skill in the art.

What is claimed is:

1. A vacuum cleaner comprising:

a housing defining first and second ports; and, a removable cap assembly engageable with the first port, the removable cap assembly comprising:

a cap head to close the first port such that airflow is directed via a flow path to the second port;

a sound-influencing material, the sound-influencing material removably held to the cap head and disposed within the flow path to reduce noise effected by the airflow;

wherein the flow path is configured to cause the airflow to pass through the sound-influencing material and the flow path to the second port;

wherein the sound-influencing material is removable to allow cleaning of the sound-influencing material wherein the cap assembly further comprises a frame coupled to the cap head to support the sound-influencing material within the flow path; and wherein the cap head comprises a plurality of locking slots, and wherein the frame comprises a support base and a plurality of legs extending therefrom, each leg having a respective resilient tab to engage a corresponding locking slot of the plurality of locking slots, such that the cap head and a cap body can be decoupled for disassembly of the cap assembly, the support base formed as a pair of concentric circles connected by radial arms.

2. The vacuum cleaner of claim 1, wherein the first port comprises a blower port and the second port comprises an exhaust port.

3. The vacuum cleaner of claim 2, wherein the housing includes a lid assembly and a tank covered by the lid assembly, and wherein the blower port and the exhaust port are defined by the lid assembly.

4. The vacuum cleaner of claim 1 wherein the sound-influencing material has a recess therein where the airflow is passed through the recess of the sound-influencing material.

5. The vacuum cleaner of claim 1, wherein the first port is operable to output airflow during operation in a first mode and the second port is operable to discharge airflow during operation in a second mode.

6. The vacuum cleaner of claim 5, wherein the first mode is a blow mode and the second mode is a vacuum mode.

7. The vacuum cleaner of claim 1, wherein the cap assembly is removed from the first port during operation in a first mode.

8. The vacuum cleaner of claim 1, wherein the sound-influencing material comprises reticulated foam to diffuse the airflow.

9. The vacuum cleaner of claim 1, wherein the sound-influencing material is an annular cylinder shape.

10. A vacuum cleaner capable of operation in a first mode and a second mode, comprising:

a housing defining a first port for output airflow during operation in the first mode and a second port for discharge airflow during operation in the second mode; and, a removable cap assembly engagable with the first port, the removable cap assembly comprising:

a cap head to close the first port such that airflow is directed via a flow path to the second port;

a sound-influencing material having a recess therein, the sound-influencing material removably held to the cap head and disposed within the flow path to reduce noise effected by the airflow;

wherein the flow path is configured to cause the airflow to pass through the recess of the sound-influencing material and the flow path to the second port;

wherein the sound-influencing material is removable to allow cleaning of the sound-influencing material wherein the cap assembly further comprises a frame coupled to the cap head and disposed in the flow path to support the sound-influencing material within the flow path; and wherein the cap head comprises a plurality of locking slots, and wherein the frame comprises a support base and a plurality of legs extending therefrom, each leg having a respective resilient tab to engage a corresponding locking slot of the plurality of locking slots, such that the cap head and a cap body can be decoupled for disassembly of the cap assembly, the support base formed as a pair of concentric circles connected by radial arms.

11. The vacuum cleaner of claim 10, wherein the housing includes a lid assembly and a tank covered by the lid assembly, and wherein the blower port and the exhaust port are defined by the lid assembly.

12. The vacuum cleaner of claim 10, wherein the airflow passes through the cap frame to allow the airflow to interact with the sound-influencing material.

13. The vacuum cleaner of claim 10, wherein the flow path is defined by interior walls of the housing positioned to effect at least one redirection of the airflow after the airflow passes through the frame and interacts with the sound-influencing material.

14. A vacuum cleaner capable of operation in a blower mode and a vacuum cleaner mode, comprising:

a housing defining a first port for output airflow during operation in the blower mode and a second for discharge airflow during operation in the vacuum cleaner mode; and, a removable cap assembly including:

a means for closing the first port such that airflow is directed via a flow path to the second port;

a sound-influencing material having a recess therein;

a means for removably holding the sound-influencing material to the means to close the first port and to position the sound-influencing material within the flow path to reduce noise effected by the airflow; and the flow path configured to cause the airflow to pass through the recess of the sound-influencing material and the flow path to the second port.

15. The vacuum cleaner of claim 14, wherein the means to close the first port comprises a plurality of locking slots, and wherein the means for holding the sound-influencing material comprises a plurality of legs, each leg having a respective resilient tab to engage a corresponding locking slot of the plurality of locking slots, such that the means to close the first port and a cap body can be decoupled for disassembly of the cap assembly.

16. The vacuum cleaner of claim 14, wherein the airflow passes through the means for holding the sound-influencing material to allow the airflow to interact with the sound-influencing material.

* * * * *